US005477248A

United States Patent [19]

Sugimoto et al.

[11] Patent Number: 5,477,248

[45] Date of Patent: Dec. 19, 1995

[54] INK-JET RECORDING METHOD AND APPARATUS USING INKS OF DIFFERENT PENETRABILITIES

[75] Inventors: Hitoshi Sugimoto; Hiromitsu Hirabayashi, both of Yokohama; Shigeyasu Nagoshi, Kawasaki; Hiroshi Tajika, Yokohama; Atsushi Arai, Kawasaki; Yuji Akiyama, Yokohama; Miyuki Matsubara, Tokyo, all of Japan

[73] Assignee: Canon Kabushiki Kaisha, Tokyo, Japan

[21] Appl. No.: 218,301

[22] Filed: Mar. 28, 1994

Related U.S. Application Data

[63] Continuation of Ser. No. 892,352, Jun. 2, 1992, abandoned.

[30] Foreign Application Priority Data

Jun. 3, 1991 [JP] Japan ..... 3-131203

[51] Int. Cl.[6] ..... B41J 2/21

[52] U.S. Cl. ..... 347/43; 347/100; 106/20 D

[58] Field of Search ..... 347/100, 43; 106/20 D

[56] References Cited

U.S. PATENT DOCUMENTS

| | | | |
|---|---|---|---|
| 4,313,124 | 1/1982 | Hara . | |
| 4,345,262 | 8/1982 | Shirato et al. . | |
| 4,380,771 | 4/1983 | Takatori . | |
| 4,459,600 | 7/1984 | Sato et al. . | |
| 4,463,359 | 7/1984 | Ayata et al. . | |
| 4,551,736 | 11/1985 | Suzuki | 347/100 |
| 4,558,333 | 12/1985 | Sugitani et al. . | |
| 4,599,627 | 7/1986 | Vollert | 347/101 |
| 4,695,846 | 9/1987 | Suzuki | 347/100 |
| 4,723,129 | 2/1988 | Endo et al. . | |
| 4,740,796 | 4/1988 | Endo et al. . | |
| 4,818,285 | 4/1989 | Causley | 106/22 |
| 4,853,036 | 8/1989 | Koike | 106/20 |
| 4,855,753 | 8/1989 | Ichikawa et al. . | |
| 4,864,328 | 9/1989 | Fischbeck . | |
| 5,196,056 | 3/1993 | Prasad | 106/20 D X |

FOREIGN PATENT DOCUMENTS

| | | |
|---|---|---|
| 54-056847 | 5/1979 | Japan . |
| 59-123670 | 7/1984 | Japan . |
| 59-138461 | 8/1984 | Japan . |
| 60-071260 | 4/1985 | Japan . |
| 3041171 | 2/1991 | Japan . |
| 2238023 | 5/1991 | United Kingdom . |

*Primary Examiner*—Joseph W. Hartary

*Attorney, Agent, or Firm*—Fitzpatrick, Cella, Harper & Scinto

[57] ABSTRACT

In an apparatus for recording color images making use of a plurality of inks of different colors (Y, M, C, K), the penetrability of at least one ink is caused to differ from that of the other inks. In particular, the penetrability of an ink higher in lightness is made higher than that of another ink lower in lightness. For example, inks are prepared in such a manner that their penetrability becomes higher in the order of K<M=C<Y, thereby permitting speedy recording of clear and sharp images free from formation of inadequate feathering at boundaries between inks of different colors.

10 Claims, 4 Drawing Sheets

INK-JET RECORDING METHOD AND APPARATUS USING INKS OF DIFFERENT PENETRABILITIES

This application is a continuation of application Ser. No. 07/892,352 filed Jun. 2, 1992, now abandoned.

BACKGROUND OF THE INVENTION

1. Field of the Invention

The present invention relates to an ink-jet recording method for conducting recording by using a plurality of inks to discharge the inks on a recording medium, and an apparatus for use in such a method.

2. Related Background Art

In recent years, apparatuses for office automation such as computers, word processors and copying machines have widely spread. A great number of recording systems, have hence been developed for use in recording apparatus thereof. Ink-jet recording apparatuses have excellent features in that they readily achieve high resolution and are excellent in low noise generation even at high speed compared with other recording systems, and moreover are inexpensive. Needs for color recording are also increasing. Therefore, a great number of color ink-jet recording apparatuses have also been developed. In the inkjet recording apparatus, an ink is jetted from a nozzle to cause the ink to adhere on a recording paper sheet, thereby forming an image. The diameter of the nozzle is as small as about 50 to 100 μm. Therefore, inks for ink-jet recording are added with a non-volatile and high-hygroscopic solvent so as to prevent the inks from evaporating and drying to clog the nozzle at its tip. However, such inks have no quick drying property on recording media after recording though they have an effect to prevent the clogging due to the deposition of dye(s) in a nozzle orifice because they become hard to dry owing to the addition of a non-volatile wetting agent.

Color ink-jet recording apparatuses involve a problem in that color mixing (boundary feathering) occurs at boundaries between an ink of a certain color and other inks of different colors due to diffusion of dyes contained in the individual inks, resulting in deterioration in image quality. This color mixing is caused by mixing of an ink, which has been discharged on a paper sheet and exists on and in the paper sheet in a state that it is not sufficiently dried and fixed, with another ink of a different color, which adjoins the former ink. This mixing is caused by diffusion of coloring matter (colorants such as dyes and pigments) in a liquid-liquid interface between different inks. Therefore, the color mixing particularly tends to occur at such boundaries between different colors when ink-jet recording inks having no quick drying property are used.

In order to impart quick drying property to inks used in ink-jet recording systems, it has heretofore been attempted to add a surface active agent into an ink, thereby lowering the surface tension of the ink to increase its penetrating power into paper so as to penetrate into paper, or to add a solvent relatively high in vapor pressure into an ink, thereby lowering the surface tension of the ink to increase its penetrating power into paper and drying the ink owing to the evaporation of this solvent. Alternatively, it has been proposed to use only paper sheets high in permeability even in the case where inks to be used have no quick drying property or to decrease (or thin out) the amount of an ink to be jetted by one scan and then repeat the scan several times at proper intervals (multipass printing). Furthermore, it has also been attempted to provide a fixing device to forcedly evaporate inks.

When the surface active agent or the solvent high in vapor pressure is added too much, however, the wettability to paper becomes higher. Therefore, dots spread in a direction parallel to the paper surface and the dot diameter becomes greater correspondingly, whereby the sharpness of their edges is lost. Furthermore, the dot density is also lowered because the penetrating power of the ink is increased, whereby the ink permeates to a greater extent in a direction perpendicular to the paper surface. Besides, the excessive addition of the solvent high in vapor pressure facilitates the evaporation of the ink and hence involves a drawback that clogging tends to occur.

If paper sheets to be used are limited to special paper sheets for exclusive use, there are drawbacks that consumers can not use those other than these paper sheets and such paper sheets are very expensive.

In the case of the multipass printing, there is a problem that the number of times of scan increases and printing time per sheet (throughput) becomes very long if an interval of time in scan is lengthened.

The use of the fixing device involves a drawback that the apparatus is made a larger size as a whole and there is a poor economy from the viewpoint of energy.

As described above, various drawbacks are involved in imparting the quick drying property to inks used in the ink-jet recording apparatus. Therefore, these must be well balanced upon designing an ink-jet recording apparatus. In order to achieve reduction in size, cheap cost and speedy recording of images, however, there is at least a problem that when an ink of a certain color adjoins another ink of a different color before they are sufficiently dried and fixed on a paper sheet, unintended mixing of coloring matter (boundary feathering) as described above occurs at their contact boundaries, resulting in an irregular and blurred image.

SUMMARY OR THE INVENTION

The present invention has been completed with the foregoing circumstances in mind and has as an object the provision of an improved ink-jet recording method and an apparatus thereof.

Another object of this invention is to provide an ink-jet recording method, which permits speedy recording of bright and sharp images free from formation of inadequate feathering at boundaries between inks of different colors, and an apparatus for use in such a method.

A further object of this invention is to provide an ink-jet recording method in which recording of images is carried out with a plurality of inks of different colors, wherein the penetrability of at least one ink into a recording medium is adjusted so as to differ from that of the other inks, and an apparatus for use in such a method.

Still a further object of this invention is to provide an ink-jet recording method, wherein the penetrability of an ink higher in lightness into a recording medium is adjusted so as to become higher than that of another ink lower in lightness, and an apparatus for use in such a method.

The above and other objects of the present invention will become apparent from the following description, taken in conjunction with the accompanying drawings.

DETAILED DESCRIPTION OF PREFERRED EMBODIMENTS

The present invention will hereinafter be described by the following examples. However, these examples are intended to illustrate the invention more specifically and are not to be construed to limit the scope of the present invention.

Figure 1:
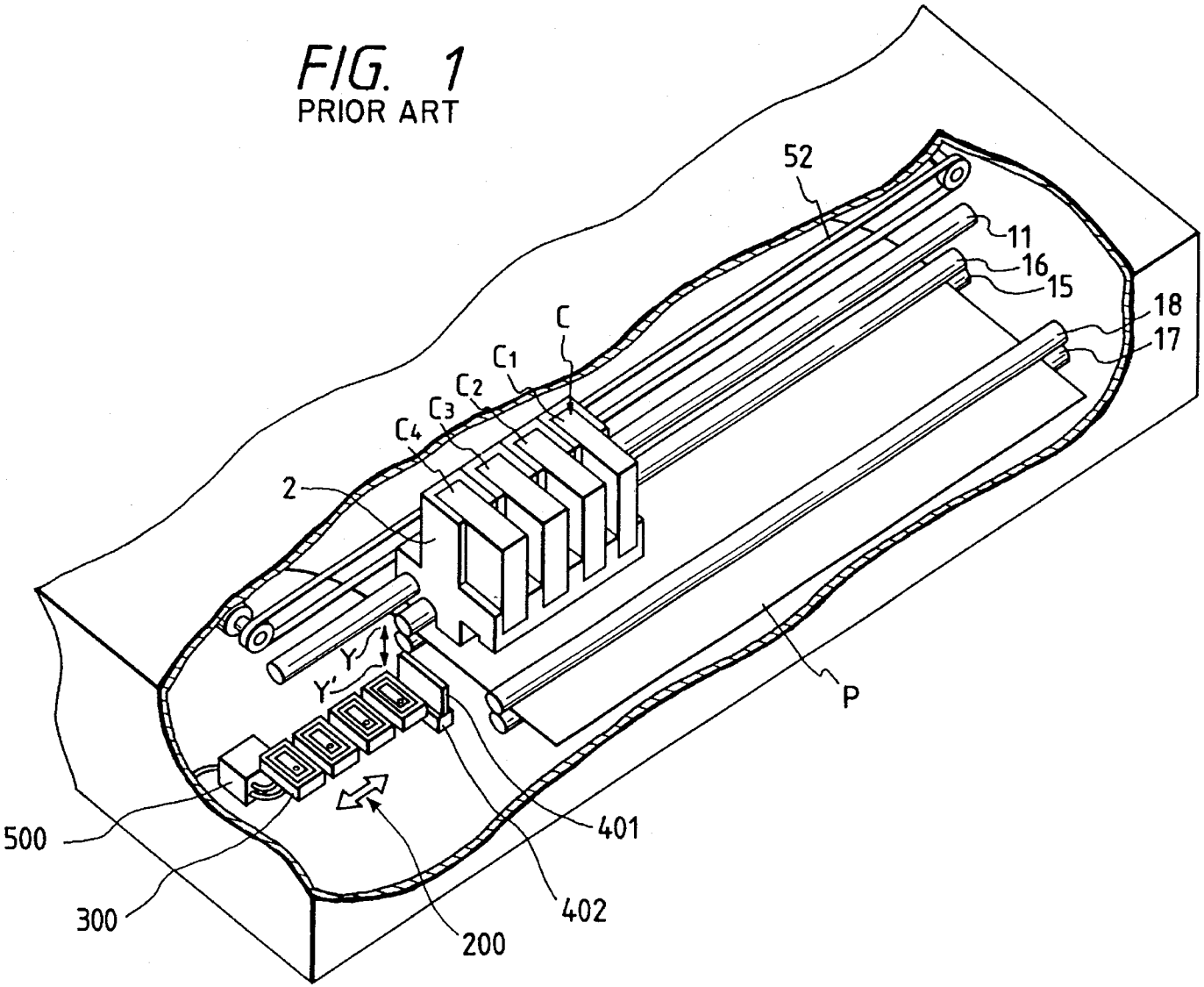
FIG. 1 PRIOR ART
FIG. 1 is a schematic illustration of an ink-jet recording apparatus to which the present invention is applied.

FIG. 1 illustrates a schematic view of an ink-jet recording apparatus to which the present invention is applied. Herein, reference character C denotes an ink-jet cartridge provided with an ink tank at its upper part and a recording head at its lower part. In addition, the cartridge C is provided with a connector adapted to receive signals or the like for driving the recording head. Reference numeral 2 indicates a carriage on which four cartridges $C_1$, $C_2$, $C_3$ and $C_4$ (in which inks of different colors, for example, yellow, magenta, cyan, black, etc., have been separately contained) are mounted in predetermined positions and moreover, a connector holder adapted to transmit the signals or the like for driving the recording head is provided. The carriage 2 is designed so as to be electrically connected to the recording head. Reference numerals 11 and 52 denote a rail for scanning, which extends in a main scanning direction of the carriage 2 and slidably supports the carriage 2, and a drive belt adapted to transmit drive power for reciprocally driving the carriage 2, respectively. Reference numerals 15, 16 and 17, 18 indicate pairs of feed rollers, which have been respectively arranged before and behind a recording position by the recording head, and feed a recording medium with it held therebetween. Reference character P designates a recording medium such as paper, which is brought into contact under pressure with a platen (not illustrated) for regulating the recording surface of the recording medium P flat. At this time, the recording head of the ink-jet cartridge C mounted on the carriage 2 projects downward from the carriage 2 and is positioned between the rollers 16 and 18 for feeding the recording medium P, and the discharging orifice-defining surface of the recording head is positioned so as to be opposed in parallel to the recording medium P brought into contact under pressure with the guide face of the platen (not illustrated).

In the ink-jet recording apparatus of this embodiment, a recovery system unit 200 is arranged on the home position side situated on the left of the drawing. In the recovery system unit, reference numeral 300 designates a cap unit provided correspondingly to each of the plural ink-jet cartridges C. The cap unit 300 is slidable in left and right directions viewed from the drawing as the carriage 2 is moved and moreover, vertically movable. The cap unit 300 comes into contact with the recording head to cap it when the carriage is situated at the home position, thereby preventing the ink within a discharging orifice of the recording head from evaporating to increase the viscosity of the ink and fix to the orifice and hence resulting in discharge failure.

In the recovery system unit 200, reference numeral 500 indicates a pump unit communicating with the cap unit 300 and adapted to generate a negative pressure to be used in a recovery treatment by suction, which is conducted by bringing the cap unit 300 into contact with the recording unit, or the like if the recording head should have discharge failure. In the recovery system unit, further, reference numeral 401 designates a blade formed with an elastic material such as rubber and serving as a wiping member. Reference numeral 402 indicates a blade holder for holding the blade 401.

In this apparatus, black, cyan, magenta and yellow inks are respectively contained in the four ink-jet cartridges $C_1$, $C_2$, $C_3$ and $C_4$ mounted on the carriage 2. In this order, these inks are overlaid on each other by reciprocally moving the carriage 2 along the rail for scanning 11. Colors between primary colors can be realized by suitably overlaying ink dots of cyan, magenta and yellow on each other. Namely, red, blue and green can be realized by overlaying magenta on yellow, cyan on magenta, and cyan on yellow, respectively.

In general, black can be realized by overlapping three colors of cyan, magenta and yellow on each other. However, the color development of black at this time is poor, and the jetted amount of the inks per unit area becomes larger. Therefore, it is generally carried out to independently jet only a black color.

First of all, color printing was conducted with four inks of cyan, magenta, yellow and black colors, which have each the following Composition 1:

| Composition 1: | |
|---|---|
| Dye | 2.5% by weight |
| Triethylene glycol | 10.0% by weight |
| Glycerol | 10.0% by weight |
| Ethyl alcohol | 5.0% by weight |
| Distilled water | 72.5% by weight |

Figure 2A:
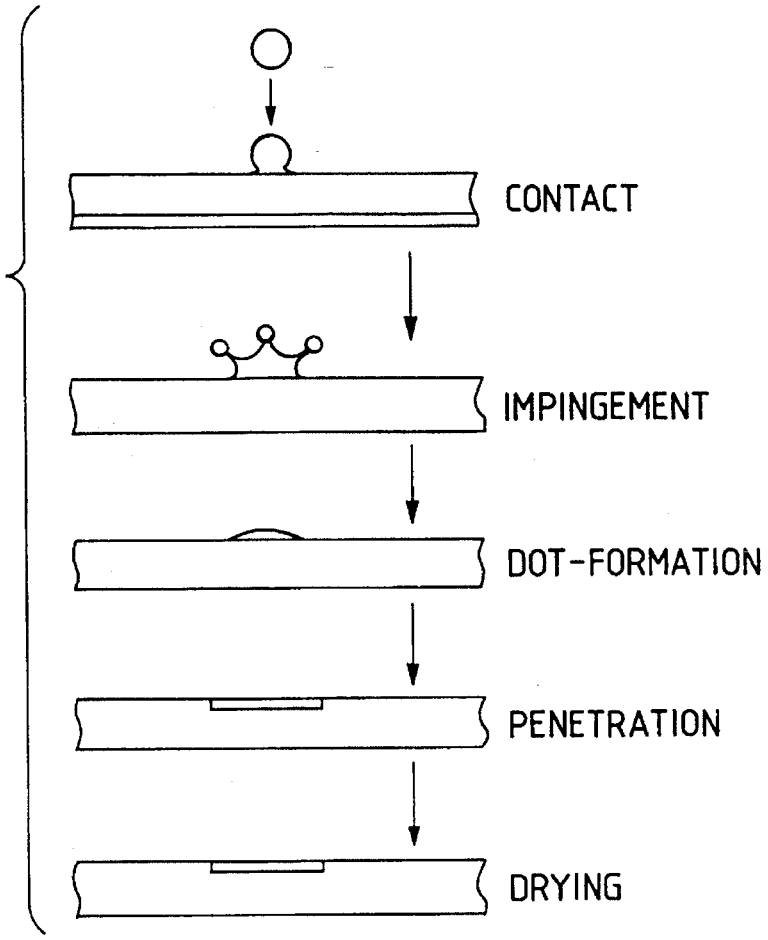
FIG. 2A PRIOR ART
FIGS. 2A and 2B illustrate the boundary feathering of an image.
Figure 2B:
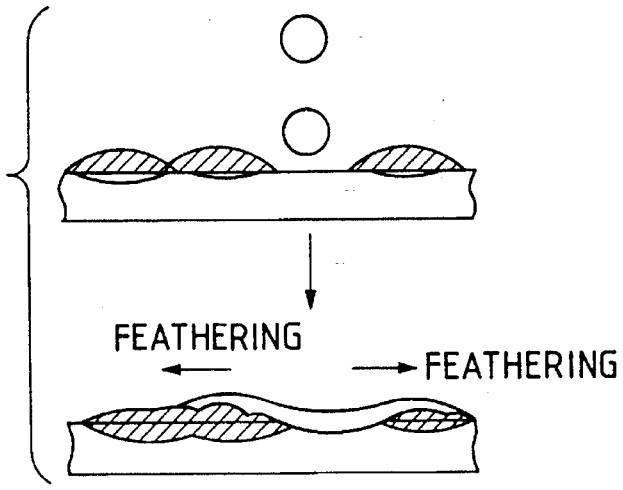
FIG. 2B PRIOR ART
Figure 5:
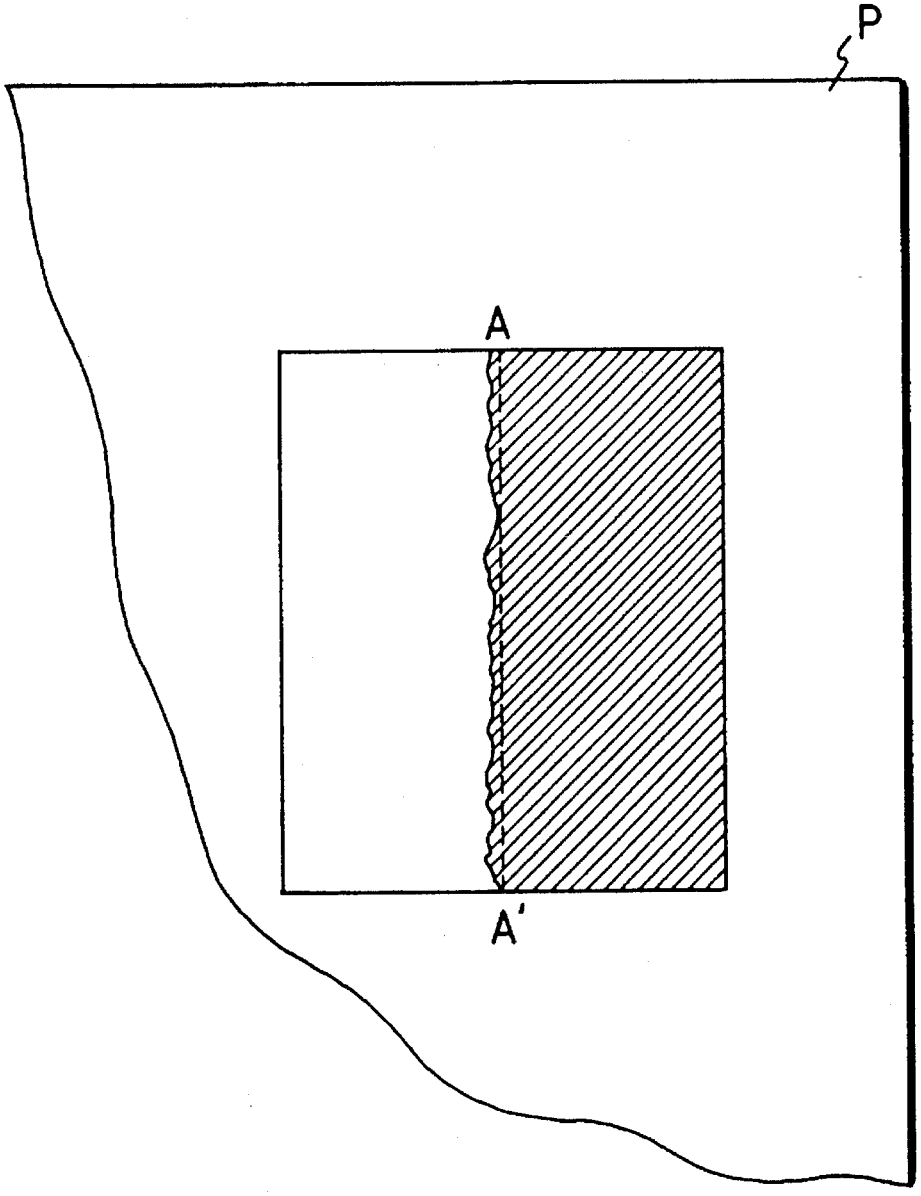
FIG. 5 PRIOR ART
FIG. 5 illustrates boundary feathering.

At this time, as illustrated in FIG. 5, unintended color mixing occurs at a boundary (on a line connecting points A and A' in the drawing) in which a solid printed area of a certain color adjoins a solid printed area of another color. Furthermore, at this time, feathering occurs along uneven irregularities and fibers on the paper surface. Therefore, this feathering does not become linearly smooth, but becomes extremely conspicuous, resulting in an image lacking in sharpness. This phenomenon is assumed to be caused by a process illustrated in FIGS. 2A and 2B. Namely, the absorption of ink into paper is believed to be advanced in the order of contact, impingement, dot-formation, penetration and drying (fixing) as illustrated in FIG. 2A. When an ink of a certain color adjoins another ink of a different color at a stage from the dot-formation to the penetration as illustrated in FIG. 2B, the diffusion of ink occurs there. When the degree of this diffusion is great, feathering occurs at the boundary.

Figure 3:
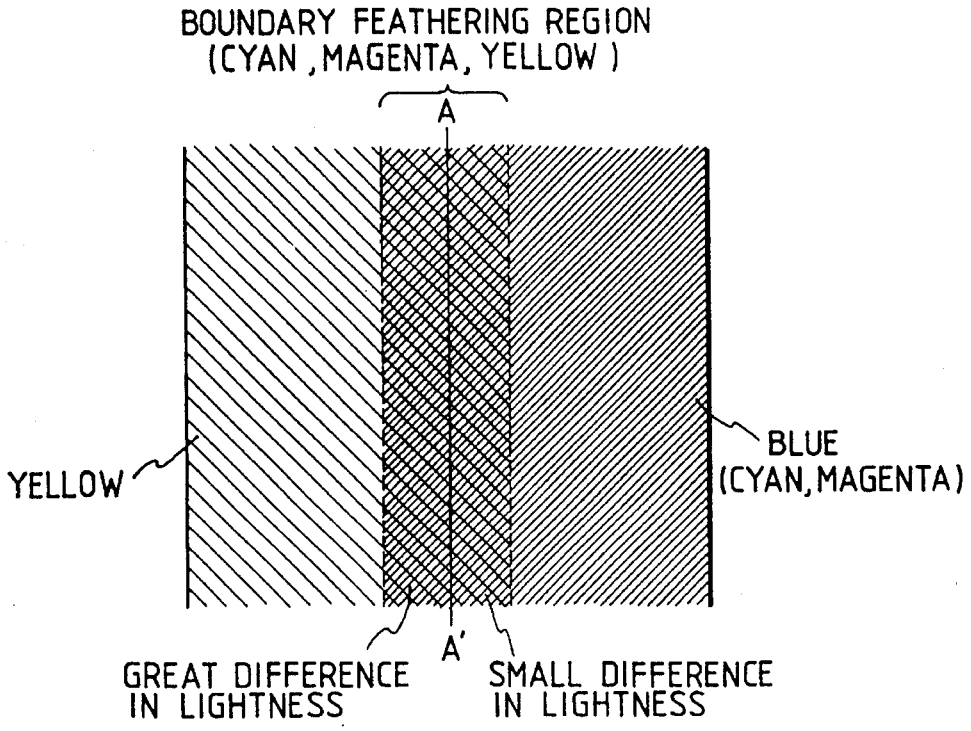
FIG. 3 PRIOR ART
FIG. 3 illustrates an influence of a difference in lightness on vision in boundary feathering.

The boundary feathering between different colors is apt to be conspicuous at the boundaries between a yellow color and other colors. This is believed to be attributed to visual effect by which the feathering looks to occur from the side lower in lightness to the side higher in lightness at boundaries between colors greatly different in lightness from each other. FIG. 3 schematically illustrates this fact. Near the boundary between yellow and blue colors, a dark feathering region in which yellow, magenta and cyan are mixed with each other appears. At this time, the difference in lightness between the color of the dark feathering region and the blue color is small. Therefore, feathering therebetween is not very conspicuous. However, the difference in lightness between the yellow color and the color of the dark feathering region is great. Therefore, it is clearly recognized that feathering occurs therebetween. Accordingly, it is believed that the feathering looks to just occur from the side of the blue color lower in lightness to the side of the yellow color higher in lightness.

EXAMPLE 1

In this invention, accordingly, an attempt to increase the penetrability of an ink high in lightness was made by changing the amount of the solvent high in vapor pressure and/or the like to be added as described above to adjust the penetrability of the ink. First of all, the penetrability of an ink having the following Composition 2 was compared with that of an ink having Composition 1 as described above in accordance with the Bristow method. As a result, it was found that the ink of Composition 2 is higher in penetrability than the ink of Composition 1.

| Composition 2: | |
|---|---|
| Dye | 2.5% by weight |
| Triethylene glycol | 10.0% by weight |
| Glycerol | 10.0% by weight |
| Ethyl alcohol | 7.0% by weight |
| Distilled water | 70.5% by weight |

Figure 4:
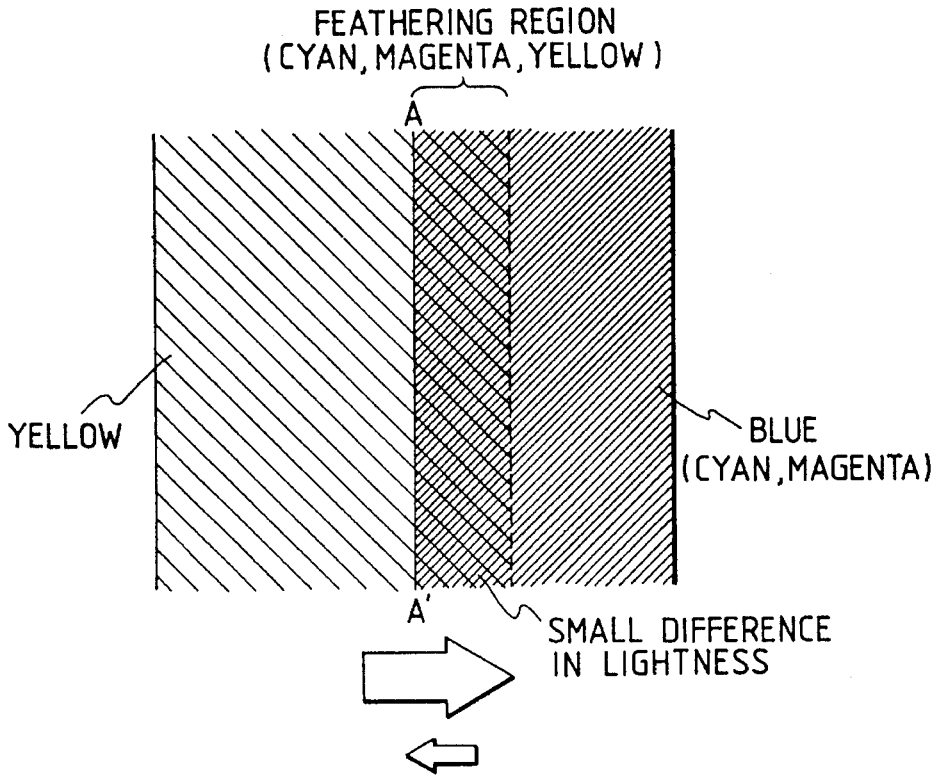
FIG. 4 illustrates a boundary region of an image when printed in accordance with the method of the present invention.

Color printing was conducted by changing the composition of the yellow ink to Composition 2 while the compositions of the black, cyan and magenta inks remained Composition 1. As a result, feathering at boundaries between the yellow color and the other colors, which was apt to be particularly conspicuous, became almost inconspicuous, thereby permitting clear recording. FIG. 4 schematically illustrates this fact. This is believed to be attributed to the fact that since the force of the yellow ink, which will flow into the cyan and magenta inks, is stronger than the force of the cyan and magenta inks, which will flow into the yellow ink, the inks other than the yellow ink are difficult to penetrate into the region of a yellow image beyond the boundary.

In this example, an alcohol high in vapor pressure was used to adjust the penetrability of the inks. However, no particular limitation is imposed on such an agent. Surface active agents or other solvents may also be used.

In the following inks, isopropyl alcohol and acetylenol as a surface active agent were used to adjust the penetrability of the inks. The penetrability of a yellow ink was made higher than that of other inks like the aforesaid example.

| Black ink: | |
|---|---|
| Dye | 3.0% by weight |
| 1,2,6-Hexanetriol | 7.0% by weight |
| Triethylene glycol | 7.0% by weight |
| Isopropyl alcohol | 1.5% by weight |
| Acetylenol | 0.01% by weight |
| Lithium acetate | 0.02% by weight |
| Distilled water | 81.47% by weight |
| Cyan ink: | |
| Dye | 2.5% by weight |
| 1,2,6-Hexanetriol | 7.0% by weight |
| Triethylene glycol | 7.0% by weight |
| Isopropyl alcohol | 1.5% by weight |
| Acetylenol | 0.01% by weight |

-continued

| | |
|---|---|
| Lithium acetate | 0.05% by weight |
| Distilled water | 81.94% by weight |
| Magenta ink: | |
| Dye | 2.5% by weight |
| 1,2,6-Hexanetriol | 7.0% by weight |
| Triethylene glycol | 7.0% by weight |
| Isopropyl alcohol | 1.5% by weight |
| Acetylenol | 0.01% by weight |
| Distilled water | 81.99% by weight |
| Yellow ink: | |
| Dye | 1.5% by weight |
| 1,2,6-Hexanetriol | 7.0% by weight |
| Triethylene glycol | 7.0% by weight |
| Isopropyl alcohol | 2.5% by weight |
| Acetylenol | 0.02% by weight |
| Lithium acetate | 0.05% by weight |
| Distilled water | 81.93% by weight |

With respect to the dye used as a colorant in each ink, any dyes may be used so long as they are free from any changes of tone and formation of any precipitate. Pigments may also be used.

EXAMPLE 2

In this example, four inks of black (K), cyan (C), magenta (M) and yellow (Y), which were used in an ink-jet recording apparatus in which the inks were jetted in the order of K, C, M and Y, were prepared in such a manner that the penetrability of the four inks into paper became higher in jetting order. In the case of ink-jet recording, an ink to be jetted subsequently tends to be attracted by another ink jetted previously to cause feathering as illustrated in FIG. 2B.

Accordingly, with respect to the jetting order of the inks, it may safely be said that it is preferred to jet an ink higher in lightness later. In this example, taking into account these facts, printing is fixed to one way and the cyan and magenta inks, the yellow ink, and the black ink were prepared in accordance with Composition 1, Composition 2 and the following Composition 3, respectively, so that the penetrability of the respective inks may satisfy the following relationship:

$$K<C=M<Y$$

| Composition 3: | |
|---|---|
| Dye | 2.5% by weight |
| Triethylene glycol | 10.0% by weight |
| Glycerol | 10.0% by weight |
| Ethyl alcohol | 3.0% by weight |
| Distilled water | 74.5% by weight |

Since the lightnesses of the cyan and magenta inks are almost equal to each other, their penetrating rates were made even. By preparing the inks in this manner, not only feathering at boundaries between the yellow color and the other colors, which was apt to be particularly conspicuous, but also feathering at boundaries of other combinations became inconspicuous, thereby permitting recording of clear and sharp color images.

EXAMPLE 3

Among ink-jet recording apparatus, there are also those in which inks were jetted in the order of C, M, Y and K. In the case of ink-jet recording, as has been described above, an ink to be jetted subsequently tends to be attracted by another ink jetted previously to cause feathering as illustrated in FIG. 2B. Accordingly, with respect to the jetting order of the inks, it is preferred to jet an ink lower in lightness earlier. In the ink-jet recording apparatus, there is a problem that fog-like minute ink droplets called mist are generated upon jetting of an ink, and these droplets adhere to the succeeding recording heads, resulting in image inferiority. The black ink particular tends to smear other inks. Therefore, the black ink is jetted last.

In this example, the black ink lowest in lightness comes to be jetted last. In the case of ink-jet recording, an ink to be jetted subsequently tends to be attracted by another ink jetted previously to cause feathering as illustrated in FIG. 2B. In this case, the black ink lowest in lightness is in a state apt to feather still more. Accordingly, it is more preferable to make the difference in penetrating rate between the black ink and the other inks still greater as shown below.

$K \ll C = M < Y$

The compositions of the inks of different colors in this example are shown below.

| | |
|---|---|
| Black ink: | |
| Dye | 2.5% by weight |
| Triethylene glycol | 10.0% by weight |
| Glycerol | 10.0% by weight |
| Ethyl alcohol | 3.0% by weight |
| Distilled water | 74.5% by weight |
| Cyan ink and magenta ink: | |
| Dye | 2.5% by weight |
| Triethylene glycol | 10.0% by weight |
| Glycerol | 10.0% by weight |
| Ethyl alcohol | 5.0% by weight |
| Acethylenol | 0.5% by weight |
| Distilled water | 72.0% by weight |
| Yellow ink: | |
| Dye | 2.5% by weight |
| Triethylene glycol | 10.0% by weight |
| Glycerol | 10.0% by weight |
| Ethyl alcohol | 7.0% by weight |
| Acethylenol | 0.5% by weight |
| Distilled water | 70.0% by weight |

Since the lightnesses of the cyan and magenta inks are almost equal to each other, their penetrating rates were made even. By preparing the inks in this manner, not only feathering at boundaries between the yellow color and the other colors, which was apt to be particularly conspicuous, but also feathering at boundaries of other combinations became inconspicuous, thereby permitting recording of clear and sharp color images.

EXAMPLE 4

When the ink-jet recording apparatus is of a both-way printing type, inks are jetted in the order of K, C, M, Y in the forward direction (upon the forward movement of the carriage 2) and in the order of Y, M, C and K in the backward direction (upon the backward movement of the carriage 2).

In the case of ink-jet recording, an ink to be jetted subsequently tends to be attracted by another ink jetted previously to cause feathering as illustrated in FIG. 2B. Therefore, the ink lower in lightness is in a state apt to feather in the direction higher in lightness in the case of the printing in the backward direction because such an ink is jetted later. Accordingly, it is more preferable to make the difference in penetrating rate between the black ink and the other inks still greater than that in the one-way printing as shown below.

$K \ll C = M \ll Y$

| | |
|---|---|
| Black ink: | |
| Dye | 2.5% by weight |
| Triethylene glycol | 10.0% by weight |
| Glycerol | 10.0% by weight |
| Ethyl alcohol | 3.0% by weight |
| Distilled water | 74.5% by weight |
| Cyan ink and magenta ink: | |
| Dye | 2.5% by weight |
| Triethylene glycol | 10.0% by weight |
| Glycerol | 10.0% by weight |
| Isopropyl alcohol | 3.0% by weight |
| Distilled water | 74.5% by weight |
| Yellow ink: | |
| Dye | 2.5% by weight |
| Triethylene glycol | 10.0% by weight |
| Glycerol | 10.0% by weight |
| 2-Butyl alcohol | 3.0% by weight |
| Distilled water | 74.5% by weight |

Since the lightnesses of the cyan and magenta inks are almost equal to each other, their penetrating rates were made even. By preparing the inks in this manner, even when conducting both-way printing, not only feathering at boundaries between the yellow color and the other colors, which was apt to be particularly conspicuous, but also feathering at boundaries of other combinations became inconspicuous, thereby permitting recording of bright and sharp color images.

EXAMPLE 5

The lightness of an ink may vary depending on the concentration of a dye contained in the ink and a recording medium to be used. Therefore, the lightness of a magenta ink may be higher than that of a cyan ink in some cases. In this case, the lightnesses of the inks become higher in the order of K, M, C and Y. In such a case, it is preferred to prepare the inks in such a manner that their penetrability becomes higher in the following order:

$K \ll M < C \ll Y$

| | |
|---|---|
| Black ink: | |
| Dye | 2.5% by weight |
| Triethylene glycol | 10.0% by weight |
| Glycerol | 10.0% by weight |
| Ethyl alcohol | 3.0% by weight |
| Distilled water | 74.5% by weight |
| Cyan ink: | |
| Dye | 2.5% by weight |
| Triethylene glycol | 10.0% by weight |
| Glycerol | 10.0% by weight |
| Isopropyl alcohol | 3.0% by weight |
| Distilled water | 74.5% by weight |
| Magenta ink: | |
| Dye | 2.5% by weight |
| Triethylene glycol | 10.0% by weight |

-continued

| | |
|---|---|
| Glycerol | 10.0% by weight |
| Isopropyl alcohol | 3.0% by weight |
| Acethylenol | 0.5% by weight |
| Distilled water | 74.0% by weight |
| Yellow ink: | |
| Dye | 2.5% by weight |
| Triethylene glycol | 10.0% by weight |
| Glycerol | 10.0% by weight |
| 2-Butyl alcohol | 3.0% by weight |
| Acethylenol | 0.5% by weight |
| Distilled water | 74.0% by weight |

In this example, not only feathering at boundaries between the yellow color and the other colors, which was apt to be particularly conspicuous, but also feathering at boundaries of other combinations also became inconspicuous like the above-described examples, thereby permitting recording of clear and sharp color images.

In the above examples, the respective color inks were prepared by thoroughly mixing and dissolving the whole components mentioned above for each ink in a container and thereafter, filtrating the resulting mixture under pressure through a Teflon (trade name) filter having a pore size of 1 μm.

The present invention can still more exhibit its effects when combined with a method in which the amount of an ink to be jetted by one scan is decreased (or thinned out) and the scan is then repeated several times at proper intervals (multipass printing), or the use of a fixing device to forcedly evaporate inks. At this time, the incorporation of the present invention permits the shortening of number of times of scan and interval of time in scan to a considerable extent and moreover the exhibition of sufficient effects even when a fixing device small in size and low in consumption power is used.

In these examples, excellent effects can be obtained particularly in a recording head and a recording apparatus of a system in which a means (for example, an electro-thermal converting element, laser beam, etc.) for generating thermal energy as energy used in discharging an ink is equipped, and the change of state of the ink is caused to take place by the thermal energy, among the ink-jet recording systems. According to such a system, recording high in density and resolution can be achieved.

With respect to its typical structure and principle, it is preferred to employ the basic-principle disclosed in, for example, U.S. Pat. Nos. 4,723,129 and 4,740,796. This system can be applied to both so-called "On-Demand" type and "Continuous" type structures. This system is advantageous to the On-Demand type in particular because an electro-thermal converting element disposed to align to a sheet or a liquid passage in which a liquid (ink) is held is applied with at least one drive signal which corresponds to information to be recorded and which enables the temperature of the electro-thermal converting element to be rapidly raised higher than a nucleate boiling point, so that thermal energy is generated in the electro-thermal converting element and film boiling is caused to take place on the surface of the recording head which is heated. As a result, bubbles can be respectively formed in the liquid (ink) in response to the drive signals. Owing to the enlargement and contraction of the bubbles, the liquid (ink) is discharged through the discharging orifice, so that at least one droplet is formed. In a case where the aforesaid drive signal is made to be a pulse signal, a further satisfactory effect can be obtained in that the bubbles can immediately and properly be enlarged/contracted and the liquid (ink) can be discharged while exhibiting excellent responsibility. It is preferable to use a drive signal of the pulse signal type disclosed in U.S. Pat. Nos. 4,463,359 and 4,345,262. Furthermore, in a case where conditions for determining the temperature rise ratio on the aforesaid heating surface disclosed in U.S. Pat. No. 4,313,124 are adopted, a further excellent recording operation can be performed.

In addition to the structure (a linear liquid passage or a perpendicular liquid passage) of the recording head formed by combining the discharging orifice, the liquid passage and the electro-thermal converting element as disclosed in the aforesaid specifications, a structure disclosed in U.S. Pat. Nos. 4,558,333 and 4,459,600 in which the heated portion is disposed in a bent portion is included in the scope of the present invention. Furthermore, the present invention can effectively be embodied in a structure in which a common slit is made to be the discharge portion of a plurality of electro-thermal converting elements and which is disclosed in Japanese Patent application Laid-Open No. 59-123670 and a structure in which an opening for absorbing thermal energy pressure waves is defined to align to the discharge part and which is disclosed in Japanese Patent Application Laid-Open No. 59-138461. Namely, according to the present invention, recording operation can be performed surely and effectively irrespective of the form of the recording head.

The present invention may be applied to a full line type recording head having a length which corresponds to the maximum width of the recording medium, which can be recorded by the recording apparatus. Such a recording head may be either a structure capable of realizing the aforesaid length and formed by combining a plurality of recording heads or a structure formed by an integrally formed recording head.

In addition, the present invention can also be effectively applied to a recording head fixed to the body of the apparatus, a structure having an interchangeable chip type recording head which can be electrically connected to the body of the apparatus or to which an ink can be supplied from the body of the apparatus when it is mounted on the body of the apparatus, or a cartridge type recording head provided with an ink tank integrally formed to the recording head itself among the above-exemplified serial type recording heads.

It is preferable to additionally provide a recording head recovery means and an auxiliary means of the recording apparatus according to the present invention because the effects of the present invention can further be stabilized. Specifically, an effect can be obtained in that the recording operation can be stably performed by providing a recording head capping means, a cleaning means, a pressurizing or sucking means, an electro-thermal converting element or another heating device or an auxiliary heating means formed by combining the aforesaid elements and by performing a preliminary discharge mode in which a discharge is performed individually from the recording operation.

Although the embodiments of this invention, which have been described above, used the liquid inks, inks which are solid at a temperature lower than room temperature, but are softened or liquefied at room temperature may be used. In the aforesaid ink-jet system, the temperature of an ink is usually controlled in a range from 30° C. to 70° C. so as to adjust the viscosity of the ink within a stable discharge range. Therefore, it is only necessary to use inks which are liquefied in response to a record signal applied. Furthermore, inks, the temperature rise of which is prevented by positively using the temperature rise due to the thermal energy as energy of state change from the solid state to the liquid state of ink or inks which are solidified when it is allowed to stand in order to prevent the evaporation of ink may be used. That is, inks which are liquefied by thermal energy for the first time such as inks liquefied by thermal energy applied in response to the record signal and discharged as ink droplets or inks which already begin to solidify when they reach the recording medium may be employed in the present invention. In this case, an ink may be, in the form of liquid or solid, held by a recess of a porous sheet or a through hole as disclosed in Japanese Patent Application Laid-Open No. 54-56847 or 60-71260 and disposed to confront the electro-thermal converting element. It is most preferable for the above-described inks that an ink be discharged by the aforesaid film boiling method.

Furthermore, the ink-jet recording apparatus according to this invention may be in the form, in addition to that used as an image-output terminal for information processing equipment such as a computer, of a copying machine combined with a reader and moreover, of a facsimile terminal equipment having a transmit-receive function or the like.

As has been described above, the present invention can provide ink-jet recording apparatuses, which are cheap and small in size and permit speedy recording of clear and sharp images free from formation of inadequate feathering at boundaries between inks of different colors, without making any changes in construction of existent apparatuses.

What is claimed is:

1. An ink-jet recording method comprising the step of:

recording an image on a recording medium using a plurality of inks of different colors and lightness, wherein the penetration rate into the recording medium of the ink of the highest lightness of the plurality of inks is higher than that of one of the other inks, and wherein the penetration rate into the recording medium of the ink of the lowest lightness is lower than that of any one of the other inks.

2. The ink-jet recording method according to claim 1, wherein the ink of the lowest penetration rate into the recording medium arrives at the recording medium prior to the arrival at the recording medium of the ink of the highest penetration rate.

3. The ink-jet recording apparatus according to claim 1, wherein the penetration rates of the inks other than the ink of the highest lightness and the ink of the lowest lightness are the same.

4. The ink-jet recording method according to any one of claims 1, 2 and 3, wherein a change of state of the plurality of inks is caused to take place by the energy generated from an energy-generating element for discharging an ink droplet, thereby discharging the ink droplet.

5. The ink-jet recording method according to claim 4, wherein the energy-generating element comprises an electro-thermal converting element.

6. An ink-jet recording apparatus comprising:

a plurality of recording means for discharging onto a recording medium a plurality of inks which are different in color and lightness from each other, the plurality of inks being used in combination to record a color image; and transfer means for moving the recording medium relative to the plurality of recording means, wherein the penetration rate into the recording medium of the ink of the highest lightness of the plurality of inks is higher than the penetration rate of any other ink, and wherein the penetration rate into the recording medium of the ink of the lowest lightness is lower than the penetration rate of any other ink.

7. The ink-jet recording apparatus according to claim 6, wherein the recording means for discharging the ink of the lowest lightness is positioned on such side of a recording region of the recording medium that the recording means arrives at the recording region prior to the arrival at the recording region of the recording means for discharging the ink of the highest lightness through the relative movement with the transfer means.

8. The ink-jet recording apparatus according to claim 6, wherein the penetration rates of the inks other than the ink of the highest lightness and the ink of the lowest lightness are the same.

9. The ink-jet recording apparatus according to claim 7, 6 or 8 wherein each of the plurality of recording means is equipped with a plurality of energy-generating elements for discharging an ink droplet and a change of state of the plurality of inks is caused to take place using the energy generated from the energy-generating elements, thereby discharging the ink droplet.

10. The ink-jet recording apparatus according to claim 9, wherein the energy-generating element is an electro-thermal converting element.

* * * * *

UNITED STATES PATENT AND TRADEMARK OFFICE

CERTIFICATE OF CORRECTION

PATENT NO. : 5,477,248 Page 1 of 2

DATED : December 19, 1995

INVENTOR(S) : Hitoshi SUGIMOTO, et al.

It is certified that error appears in the above-indentified patent and that said Letters Patent is hereby corrected as shown below:

COLUMN 6:

Line 66, "apparatus," should read --apparatuses,--.

COLUMN 7:

Line 9, "ink" should read --ink in--;
Line 38, "Acethylenol" should read --Acetylenol--;
Line 44, "Acethylenol" should read --Acetylenol--.

COLUMN 9:

Line 5, "Acethylenol" should read --Acetylenol--;
Line 11, "Acethylenol" should read --Acetylenol--.

UNITED STATES PATENT AND TRADEMARK OFFICE

CERTIFICATE OF CORRECTION

PATENT NO. : 5,477,248 Page 2 of 2

DATED : December 19, 1995

INVENTOR(S) : Hitoshi SUGIMOTO, et al.

It is certified that error appears in the above-indentified patent and that said Letters Patent is hereby corrected as shown below:

COLUMN 11:

Line 34, "one" should read --any one--.

COLUMN 12:

Line 36, "8" should read --8,--;
Line 43, "is" should read --comprises--.

Signed and Sealed this

Thirtieth Day of April, 1996

*Attest:*

BRUCE LEHMAN

*Attesting Officer*

*Commissioner of Patents and Trademarks*